US006116990A

United States Patent [19]

Sinclair et al.

[11] Patent Number: 6,116,990

[45] Date of Patent: Sep. 12, 2000

[54] ADJUSTABLE LOW PROFILE GIMBAL SYSTEM FOR CHEMICAL MECHANICAL POLISHING

[75] Inventors: James Sinclair, San Jose, Calif.; Daniel R. Trojan, Phoenix, Ariz.; Lawrence L. Lee, Sunnyvale, Calif.

[73] Assignee: Applied Materials, Inc., Santa Clara, Calif.

[21] Appl. No.: 09/247,769

[22] Filed: Feb. 9, 1999

Related U.S. Application Data

[63] Continuation-in-part of application No. 08/900,808, Jul. 25, 1997, Pat. No. 5,899,798.

[51] Int. Cl.[7] ..... B24B 5/02; F16C 25/04

[52] U.S. Cl. ..... 451/259; 451/287; 451/288; 451/398; 384/193; 384/206

[58] Field of Search ..... 451/285, 286, 451/287, 288, 289, 290, 398, 259; 384/193, 194, 206, 228

[56] References Cited

U.S. PATENT DOCUMENTS

| | | | |
|---|---|---|---|
| 3,518,798 | 7/1970 | Boettcher . | |
| 3,781,071 | 12/1973 | Kauzlarich . | |
| 3,833,230 | 9/1974 | Noll . | |
| 4,194,324 | 3/1980 | Bonora et al. . | |
| 4,270,314 | 6/1981 | Cesna . | |
| 4,313,284 | 2/1982 | Walsh . | |
| 4,811,522 | 3/1989 | Gill, Jr. . | |
| 4,954,142 | 9/1990 | Carr et al. . | |
| 5,081,795 | 1/1992 | Tanaka et al. . | |
| 5,099,750 | 3/1992 | Rebel . | |
| 5,183,350 | 2/1993 | Kramer | 403/4 |
| 5,193,316 | 3/1993 | Olmstead . | |
| 5,297,361 | 3/1994 | Baldy et al. . | |
| 5,329,732 | 7/1994 | Karlsrud et al. . | |
| 5,335,453 | 8/1994 | Baldy et al. . | |
| 5,377,451 | 1/1995 | Leoni et al. . | |
| 5,384,986 | 1/1995 | Hirose et al. . | |
| 5,398,459 | 3/1995 | Okumura et al. . | |
| 5,423,558 | 6/1995 | Koeth et al. . | |
| 5,486,131 | 1/1996 | Cesna et al. . | |
| 5,498,199 | 3/1996 | Karlsrud et al. . | |
| 5,571,044 | 11/1996 | Bolandi et al. . | |
| 5,582,534 | 12/1996 | Shendon et al. . | |
| 5,916,015 | 6/1999 | Natalicio | 451/288 |

FOREIGN PATENT DOCUMENTS

| | | |
|---|---|---|
| 774323 A2 | 5/1997 | European Pat. Off. . |
| 63-62668 | 3/1988 | Japan . |

OTHER PUBLICATIONS

Dialog® English abstract of Japanese Patent Publication No. 63–62668 (Mar. 18, 1988). One page total.

*Primary Examiner*—Timothy V. Eley
*Attorney, Agent, or Firm*—Thomason, Moser & Patterson

[57] ABSTRACT

A low profile gimbal system is provided to greatly reduce the generation of moments about a pivot point of the gimbal system during polishing processes. The gimbal system is adjustable so that a preferred balance between stiffness and friction may be selected as appropriate for a variety of different polishing conditions. A locking feature ensures that the adjustment setting is maintained during polishing.

32 Claims, 9 Drawing Sheets

4B

ADJUSTABLE LOW PROFILE GIMBAL SYSTEM FOR CHEMICAL MECHANICAL POLISHING

CROSS-REFERENCE TO RELATED APPLICATIONS

This application is a continuation-in-part of application Ser. No. 08/900,808 filed on Jul. 25, 1997, entitled "LOW PROFILE LOW HYSTERESIS FORCE FEEDBACK GIMBAL SYSTEM FOR CHEMICAL MECHANICAL POLISHING", now U.S. Pat. No. 5,899,798.

TECHNICAL FIELD

The present invention relates to a self-aligning pivot used in apparatuses for polishing. Among applicable polishing apparatuses, are those used in the polishing of semiconductor wafers of the type from which chips for integrated circuits and the like are made. More specifically in a chemical mechanical polishing or planarization (CMP) process a semiconductor wafer is held by a substrate carrier and is polished by contact with an abrasive material in a controlled chemically active environment.

BACKGROUND ART

As part of the manufacturing process of semiconductor devices, semiconductor wafers are polished by CMP. The uniform removal of material from and the planarity of patterned and un-patterned wafers is critical to wafer process yield. Generally, the wafer to be polished is mounted on a substrate carrier which holds the wafer using a combination of vacuum suction or other means to contact the rear side of the wafer and a retaining lip or ring around the edge of the wafer to keep the wafer centered on the substrate carrier. The front side of the wafer, the side to be polished, is then contacted with an abrasive material such as an abrasive pad or abrasive strip. The abrasive pad or strip may have free abrasive fluid sprayed on it, may have abrasive particles affixed to it, or may have abrasive particles sprinkled on it.

The ideal wafer polishing process can be described by Preston's equation:

$R=K_p*P*V$, where R is the removal rate; Kp is a function of consumables (abrasive pad roughness and elasticity, surface chemistry and abrasion effects, and contact area); P is the applied pressure between the wafer and the abrasive pad; and V is the relative velocity between the wafer and the abrasive pad. As a result, the ideal CMP process should have constant cutting velocity over the entire wafer surface, constant pressure between the abrasive pad and wafer, and constant abrasive pad roughness, elasticity, area and abrasion effects. In addition, control over the temperature and pH is critical and the direction of the relative pad/wafer velocity should be randomly distributed over the entire wafer surface.

One common type of wafer polishing apparatus is the CMP model 372M made by Westech Systems Inc. A wafer is held by a substrate carrier of the model 372M. The substrate carrier rotates about the axis of the wafer. A large circular abrasive pad is rotated while contacting the rotating wafer and substrate carrier. The rotating wafer contacts the larger rotating abrasive pad in an area away from the center of the abrasive pad.

Another related apparatus is a polishing machine for polishing semiconductor wafers containing magnetic read-write heads, disclosed in U.S. Pat. No. 5,335,453 to Baldy et al. With this machine, a semiconductor wafer is held by a substrate carrier which is moved in a circular translatory motion by an eccentric arm. The wafer is polished by contacting an abrasive strip which is advanced in one direction. The relative motion between the wafer and the abrasive strip is a combination of the circular motion of the wafer and the linear motion of the advancing abrasive strip.

While the precessing circle polishing pattern should pro vide more uniform velocities such that different points on the wafer see similar velocities at any given time, the velocities are still not constant. Assuming the rotation of the eccentric arm is held to a constant angular speed, the precessing circle relative motion results in fluctuating velocities. When the wafer is rotating away from the precessing direction the net relative velocity is lower, and when the wafer is rotating with precessing direction the net relative velocity is higher.

The gimbal point of a CMP substrate carrier is a critical element of the polishing process. The substrate carrier must align itself to the polish surface precisely to insure uniform, planar polishing results. Many CMP substrate carriers currently available yield wafers having anomalies in planarity. The vertical height of the pivot point above the polishing surface is also important, since the greater the height, the larger the moment that is induced about the pivot point during polishing. Two pervasive problems that exist in most CMP wafer polishing apparatuses are underpolishing of the center of the wafer, and the inability to adjust the control of wafer edge exclusion as process variables change.

For example, substrate carriers used on many available CMP machines experience a phenomenon known in the art as "nose diving". During polishing, the head reacts to the polishing forces in a manner that creates a sizable moment, which is directly influenced by the height of the gimbal point, mentioned above. This moment causes a pressure differential along the direction of motion of the head. The result of the pressure differential is the formation of a standing wave of the chemical slurry that interfaces the wafer and the abrasive surface. This causes the edge of the wafer which is at the leading edge of the substrate carrier, to become polished faster and to a greater degree than the center of the wafer.

The removal of material on the wafer is related to the chemical action of the slurry. As slurry is inducted between the wafer and the abrasive pad and reacts, the chemicals responsible for removal of the wafer material gradually become exhausted. Thus, the removal of wafer material further from the leading edge of the substrate carrier (i.e., the center of the wafer) experiences a diminished rate of chemical removal when compared with the chemical action at the leading edge of the substrate carrier (i.e., the edge of the wafer), due to the diminished activity of the chemicals in the slurry when it reaches the center of the wafer. This phenomenon is sometimes referred to as "slurry starvation".

Apart from attempts to reshape the crown of the substrate carrier, other attempts have been made to improve the aforementioned problem concerning "nose diving". In a prior art substrate carrier that gimbals through a single bearing at the top of the substrate carrier, sizable moments are generated because the effective gimbal point of the substrate carrier exists at a significant, non-zero distance from the surface of the polishing pad. Thus, the frictional forces, acting at the surface of the polishing pad, act through this distance to create the undesirable moments.

U.S. Pat. No. 5,377,451 to Leoni et al. describes a wafer carrier that "projects" the effective gimbal point down to the surface of the polishing pad, thereby eliminating the moment arm through which the frictional forces create the undesirable "nose diving". Leoni et al. produce this effect by instituting a conical bearing assembly which allows the projection of a "universal pivot point" to a point that is located at or near the surface of the polishing surface. The solution proposed by Leoni et al., however, requires the use of a number of bearings in the assembly in order to effect this projection, thereby increasing the cost of the wafer carrier. Additionally, there is still a moment produced because of the actual contact points at the bearings. There is also a substantial risk that, due to inexact manufacturing, the projected pivot point will not lie exactly on the contact surface of the carrier, which will also introduce moments.

Other problems encountered in current gimbal designs include uneven applications of forces to the substrate during polishing due to looseness or vibrations in the gimbal mechanism that develop during the polishing motions that the carrier goes through during polishing. These types of problems increase over the life of the carrier/gimbal due to wear. While these problems are experienced in systems employing slurry as a polishing medium, they are even more evident in systems using a "slurryless" polishing medium such as a fixed abrasive type of polishing medium, such as, for example the STRUCTURED ABRASIVE™ IPS 2100, which is available from 3M Corp. of Minneapolis, Minn. When using slurryless media, higher frictions are experienced and a phenomenon known as "stick-slip" or "stiction" may also be experienced. Each of these phenomenon add to development of vibration problems. Inexact manufacturing practice further contribute to the development and amplification of vibration problems leading to aberrant polishing results.

DISCLOSURE OF THE INVENTION

The present invention includes a novel gimbal arrangement which renders the mount that it supports to be self-aligning, and offers a substantial reduction, compared to standard ball gimbal systems, in the magnitudes of frictional moments produced at the surface of the mount effecting the polishing motion, for example, without the need of creating a separate bearing assembly having multitudinous bearings.

Another advantage provided by the present invention is precision. Precision polishing of substrates is enhanced by lessening the occurrences of "nose-diving" by the reduction in torque moments during polishing which are achieved by the gimbal arrangements disclosed herein.

Additionally, the present invention provides a lower cost method of addressing the problems of "nose-diving" inherent in systems having a sizable moment arm inherent when the pivot point of a substrate carrier is substantially distant from the polishing surface of the substrate. The present invention moves the pivot point much closer to the polishing surface.

Another advantage of the present invention is adjustability of the tolerances between the bearing surfaces of the gimbal system, allowing it to be adjusted with regard to stiffness characteristics for optimum performance under a variety of polishing conditions. Additionally, the system can be adjusted to accommodate wear that occurs over time.

The present invention provides a low profile adjustable gimbal system including a first bearing surface adapted to be mounted to a plate or portion of a carrier; a gimbal shaft having a second bearing surface which engages the first bearing surface; a third bearing surface adapted to be mounted to the plate or a portion of the carrier to support vertical forces; a fourth bearing surface which engages the third bearing surface; and an adjuster movably mounted to the gimbal shaft. Movement or adjustment of the adjuster with respect to the gimbal shaft varies the tolerances between the first and second bearing surfaces, and between the third and fourth bearing surfaces, simultaneously.

A locking mechanism is further provided which abuts the adjuster to prevent movement thereof after the adjustment has been completed. The gimbal shaft is vertically aligned along a substantially vertical central axis. The first bearing surface of the gimbal system tapers away from the central axis in a direction from a top to a bottom of the first bearing surface. Preferably, the tapered surface forms an angle of about 15 degrees to the vertical or central axis. The second bearing surface is preferably formed as a portion of a spherical surface that substantially mates with the first bearing surface along the taper.

Preferably, the adjuster is vertically movable with respect to the gimbal shaft. Vertical movement of the adjuster downward with respect to the gimbal shaft forces the fourth bearing surface against the third bearing surface. Adjustment of the adjuster downward with respect to the gimbal shaft also forces the gimbal shaft and the second bearing surface against the first bearing surface. Preferably, the adjuster includes a shaft which threadably engages the gimbal shaft.

The locking mechanism preferably includes a washer which abuts the adjuster with a force to prevent movement of the adjuster. At least one threaded member is torqued against the washer to apply the locking force against the adjuster. Preferably the threaded member includes at least one set screw, more preferably an arrangement of four set screws.

Advantageously, the radii of curvature of each of the second, third and fourth bearing surfaces are preferably concentrically arranged. The concentric arrangement is preferably about a point substantially below the gimbal system, such that the center of rotation of the gimbal system is projected downward to the point.

The gimbal shaft is dimensioned to be press fit within a supporting mount. A pattern of threaded holes are formed through the top of the gimbal shaft to receive bolts or screws passed through the supporting mount, which are torqued to draw the gimbal shaft into a press fit with the supporting mount.

Further disclosed is a gimbal arrangement in a polishing apparatus, which includes a carrier mount having a first bearing surface; a supporting mount; and a gimbal shaft interconnecting the carrier mount and supporting mount. The gimbal shaft has a bearing surface which contacts the bearing surface of the carrier mount. A third bearing surface is supported by the carrier mount, and a fourth bearing surface engages the third bearing surface to vertically support the arrangement.

An adjuster is movably mounted to the gimbal shaft, such that movement of the adjuster with respect to the gimbal shaft varies the relative vertical positioning of the third bearing surface with respect to the second bearing surface. Further disclosed is a lock which is releasably engageable with the adjuster. When engaged, the lock prevents movement of the adjuster with respect to the gimbal shaft.

Still further, a gimbal arrangement in a polishing apparatus is described to include a carrier mount, a supporting mount, and a gimbal shaft interconnecting the carrier mount and the supporting mount. At least one set of bearing surfaces support the contact between the gimbal shaft and the carrier mount. An adjuster is movably mounted to the gimbal shaft, so that movement of the adjuster relative to the gimbal shaft varies a relative distance between at least one set of bearing surfaces. A lock releasably engages the adjuster. When engaged, the lock prevents movement of the adjuster with respect to the gimbal shaft.

The radii of curvature of the curved bearing surfaces of the gimbal system are preferably substantially concentrically arranged about a single point. Preferably the point is located substantially lower than the gimbal arrangement, thereby lowering the pivot point of the system.

Other advantages and features of the present invention will become clear in the detailed description of the invention as read in conjunction with the accompanying figures.

BEST MODE FOR CARRYING OUT THE INVENTION

Figure 1:
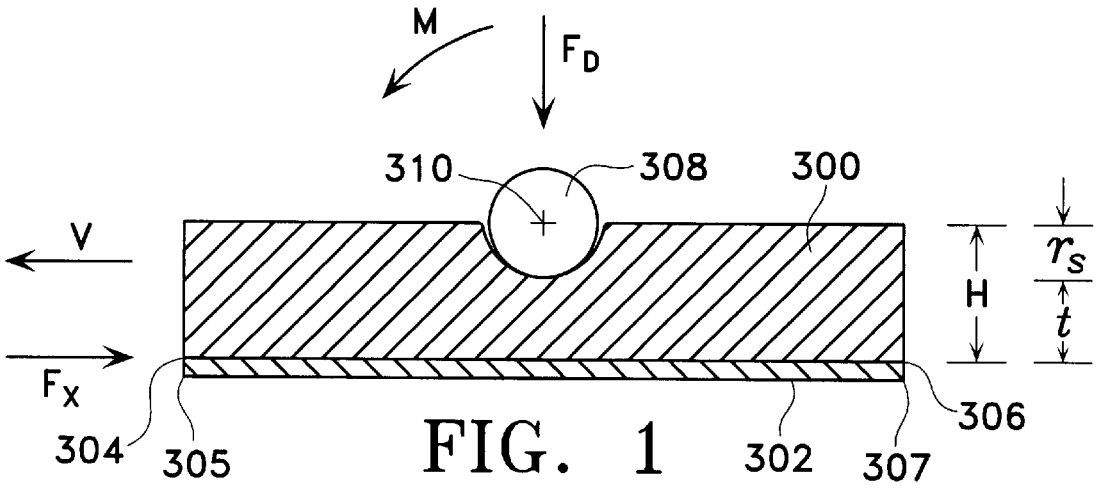
FIG. 1 (PRIOR ART)
FIG. 1 is a diagrammatic representation illustrating the contribution of a standard gimbal system to the phenomenon of "nose-diving"

The following description refers to specific embodiments by way of reference to the figures and reference numerals contained therein. The description is for purposes of satisfying disclosure requirements and is not to be limiting of the invention, which is defined by the claims below, and which includes equivalents thereof.

FIG. 1 is a diagrammatic representation illustrating the contribution of a standard gimbal system to the phenomenon of "nose-diving". Downward force $F_D$ is applied to substrate carrier 300 through gimbal ball 308 via a CMP polishing machine (not shown). The force upon substrate carrier 300 is transferred upon substrate 302 to effectuate and enhance chemical-mechanical polishing of the substrate 302. Ideally, a uniform distribution of the force $F_D$ through substrate carrier 300 is preferred, for an even application of force to substrate 302 so that the surface of substrate 302 will experience a consistent rate of polishing over all of the surface to be polished.

In reality, however, the substrate carrier 300 and substrate 302 must be moved, with respect to a polishing pad to effectuate the polishing action. Assuming substrate carrier 300 (as well as gimbal ball 308) and substrate 302 are moving in direction V in FIG. 1, there is a friction force $F_X$ generated in a direction opposite to V, caused by the interaction between the polishing surface and the bottom surface (or front side) of substrate 302. Because substrate carrier 300 is able to gimbal through a pivot point 310 in gimbal ball 308, a moment M is applied to substrate carrier 300 and thus to substrate 302. Moment M is the product of the frictional force $F_X$ times the distance from the application of frictional force $F_X$ to the point 310 at which the gimballing occurs and where the moment is generated. Specifically, this distance is defined by the height H of the substrate 302 and substrate carrier 300 in FIG. 1.

Because the thickness of the substrate 302 is substantially a constant when presented for the polishing process, and because the substrate carrier 300 very often envelopes the substrate during processing with one or another form of retaining ring, it can be stated that the moment M is substantially dependent upon the height of the substrate carrier 300 in this case. The effect of moment M is to increase the downward force applied to the leading edge 304 of substrate carrier 300 and leading edge 305 of substrate 302, and to reduce the downward force on the trailing edge 307 of the substrate 302 and trailing edge 306 of substrate carrier 300.

Figure 2:
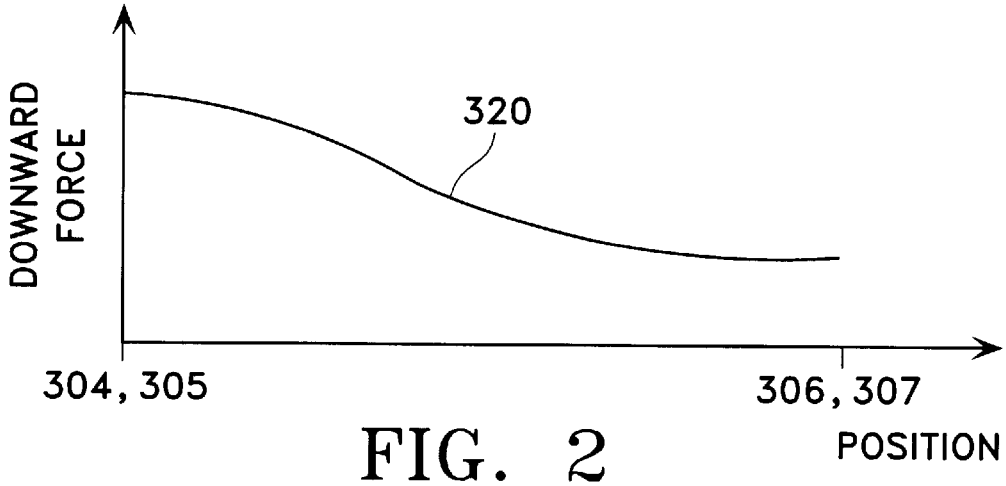
FIG. 2 (PRIOR ART)
FIG. 2 is a graphical representation illustrating the uneven force application across the polishing surface of a substrate as it experiences "nose-diving"

FIG. 2 is a graphical representation of the effect of moment M upon the downward force applied through substrate carrier 300 and substrate 302. Because of the increased force on the leading edge side, the result is that the leading edge side of the lower surface of substrate 302 experiences more wear through polishing than the trailing edge side per unit of time. The profile 320 of the force applied to the substrate 302 is proportional to the height H. This effect is problematic, since one of the goals of polishing is to obtain a perfectly planar surface on the substrate 302.

To address this problem, one way of reducing the moment M would be to reduce the height of substrate carrier 300. However, if the substrate carrier is made too thin it tends to flex under load and possibly may even fail during a polishing process. Other performance requirements make significant reduction of the height of the substrate carrier difficult to achieve, as well. A more realistic approach to reducing the height or distance H is to lower the gimbal point, i.e., by reducing the distance between gimbal point 310 and the lower surface of substrate 302.

As previously mentioned, several prior art solutions employ the use of a set of gimbal bearings that are aligned so that the "effective" pivot point can be reflected to reside on the surface of the polishing surface; thereby effectively eliminating the problem of undesirable torque. As also mentioned, this solution requires a potentially costly design to improve over the traditional "ball-and-socket" gimbal arrangement, such as that diagrammed in FIG. 1, while at the same time placing more exacting machining requirements to ensure that the projected or effective pivot point lies exactly upon the contact surface of the carrier.

Further, no inherent improvement in the pressure profile is observed beyond a reduction in H less than about 0.75 inches in the present embodiments However, reducing the force hysteresis of the load/gimbal system significantly improves the uniformity of the polished surfaces obtained from substrate to substrate, i.e., the repeatability of the process is greatly improved with the present invention.

The pivot point of a ball gimbal (i.e., ball and socket gimbal arrangement) such as that shown in FIG. 1, is defined by the point where horizontal and vertical forces intersect, i.e., the point defined by reference numeral 310 in FIG. 1. Thus, the height or distance H affecting the moments formed in this type of system must always be greater than the radius of the gimbal ball used in such a system. Specifically, $H=r_g+t$ in the example shown in FIG. 1, where $r_g$ defines the radius of the gimbal ball 308 and t defines the thickness of the substrate carrier 300 between the gimbal ball 308 and the substrate 302.

One aspect of the present invention improves over the traditional "ball-and-socket" arrangement, by removing the requirement that the lower limit of H always be greater than the radius of a gimbal ball. The present invention reduces the H dimension without the attendant increased costs due to a more complicated and numerous set of gimbal bearings.

Figure 3:
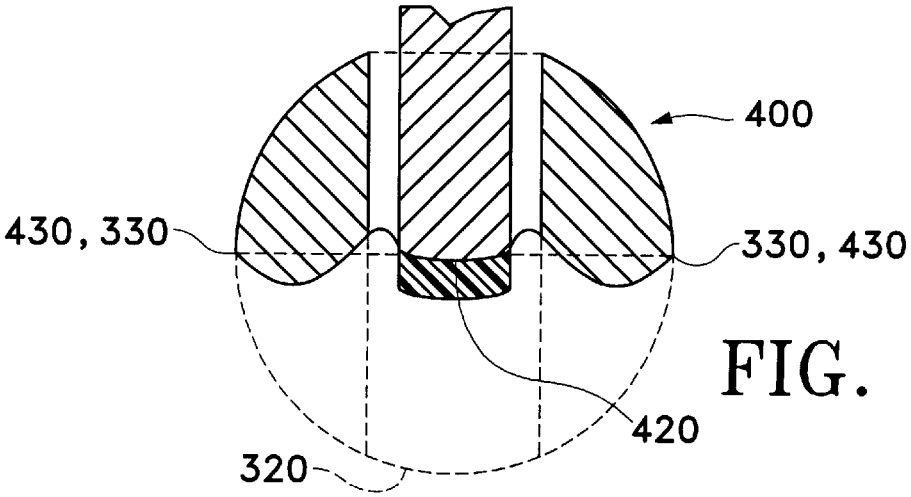
FIG. 3 is a representation of the modifications which have been made to a traditional gimbal ball to achieve a dual radius gimbal bearing according to the present invention.

FIG. 3 shows the modifications which have been made to a traditional gimbal ball (in phantom lines) to achieve a dual radius gimbal bearing according to the present invention. The theory behind the modifications is that by moving the vertical point of contact 320 of a standard gimbal ball, up to a position 420 of horizontal alignment with the contact line of action 430 (which is the same as the contact line of action 330 of the standard gimbal ball), height H of the pivot point is reduced to be equal to merely the thickness t of the substrate carrier between position 420 and the substrate 302. Since thickness t, in actuality is generally much less than 1.5 inches (e.g., about 0.600 inches), the present invention greatly reduces the amount of moment produced during chemical mechanical polishing. At the same time, the effective radius of the "ball" (i.e., puck) 400 remains large (i.e., the same as that of the standard gimbal ball) in the horizontal direction to distribute horizontal stress levels.

Figure 4A:
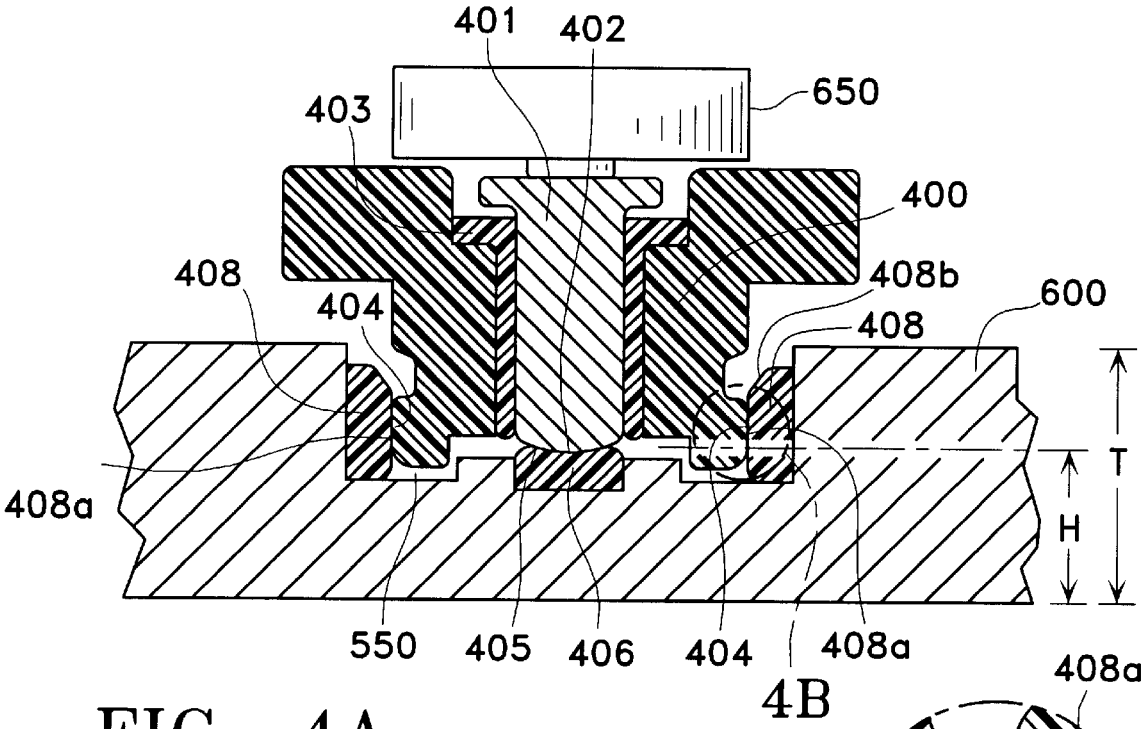
FIG. 4A is a cut-away, sectional view of a dual radius gimbal bearing according to the present invention.

Because of the large down forces which are required for effective CMP polishing, a standard gimbal ball must have a fairly large radius so that the contact surface distributes the force sufficiently over a bearing surface to preclude damage to the bearing surface during down force transfer. Standard gimbal ball radiuses are on the order of 1.5 inches or even greater. Thus, an effective substrate carrier can be produced to have a thickness, at the contact point with a gimbal, which is significantly less than the diameter of a standard gimbal ball. In combination with the present invention, the result is to greatly reduce "nose-diving" effects which are attributable to the standard gimbal arrangement. The foregoing explains the resultant shape of the puck 400, which is also shown in FIG. 4A.

In the standard gimbal ball system shown in FIG. 1, the bearing surface 312 of the socket has a radius of curvature which substantially matches the radius of curvature of ball 308. Such an arrangement tends to produce sliding friction between the bearing surface and ball surface during gimballing.

Another aspect of the present invention is to significantly reduce this source of friction. For example, in the embodiment shown in FIG. 4A, the radius of curvature of the bearing surface 405 of contact button 406 is significantly larger than the radius of curvature of the vertical force gimbal surface 402, which is mounted on or integral with contact pin 401. Contact pin 401 is preferably made of the same material as puck 400, but is separately mounted therein. For example, for a vertical force gimbal surface having a radius of curvature of about 1.5 inches, a contact button having a bearing surface with a radius of curvature of about 2.0 inches could be used. Consequently, a truer rolling motion is obtained between surfaces 402 and 405 during gimballing, since a much smaller area of the gimbal surface 402 actually contacts the contact button 406 at any given gimballing attitude, as compared to the standard ball and socket type gimbal arrangement.

Figure 4B:
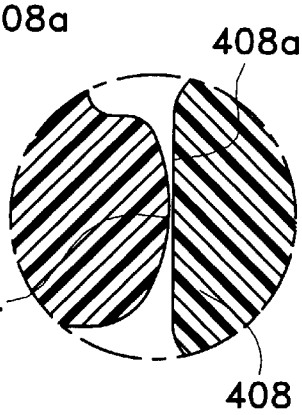
FIG. 4B is a magnified partial view which exaggerates the difference in radii of curvature between the surfaces depicted as 404 and 408*a* in FIG. 4A.

With the ball and socket having different radii, a problem arises as to the horizontal restraint on the gimbal mechanism. As shown in FIGS. 4A and 4B, horizontal force gimbal surface 404 is provided on the differential radius puck 400. A low friction ring 408 is provided for transferring lateral forces between the substrate plate 600 and the horizontal force gimbal surface 404. The surface of contact 408*a* of ring 408 is substantially cylindrical. The contact surface 404 on the other hand, has a radius of curvature that is substantially equal to the distance from the center of surface 402 to the center of the surface 404. The radius of curvature of contact surface 404 may be lesser or greater than the radius of curvature of surface 402. It is important only that the radius of curvature of surface 404 be substantially less than the radius of curvature of surface 408*a*, to obtain the same reduction in sliding friction and improvement in rolling action described above with respect to the vertical force gimbal surface. Ring 408 is preferably chamfered at 408*b* to facilitate the positioning of puck 400 within the gimbal system.

Ring 408 and contact button 406 are preferably formed. of low friction plastic, which is made possible by the fairly large radii of curvature of the contact surfaces of the puck 400 and surface 402. Ring 408 and button 406 are most preferably formed of DELRIN, or another substantially equivalent linear acetyl resin. Other suitable low friction plastics include polyphenko ertalyte. Still further, other low friction materials such as ceramics may be successfully employed. The substrate plate 600 and puck 400 are preferably formed of stainless steel, more preferably hardened stainless steel, but other metals having sufficient strength and wear resistance, such as aluminum or brass, for example, may be alternatively used.

It is important to note that one of the features of the present invention is the division of the horizontal and vertical constraints on gimballing as distinguished from the traditional "ball-and-socket" arrangement where the horizontal and vertical constraints occur at the same point of contact of the ball with the socket.

Another preferred feature of the differential radius puck 400 is that the vertical and horizontal constraints (or points of contacts) are co-planar. This is the preferred embodiment for the presently claimed gimbal arrangement because if these constraint points were not co-planar, then the improvement of the effective gimbal point becomes the point furthest away from the polishing surface; thus resulting in an increase in frictional moment.

Figure 5:
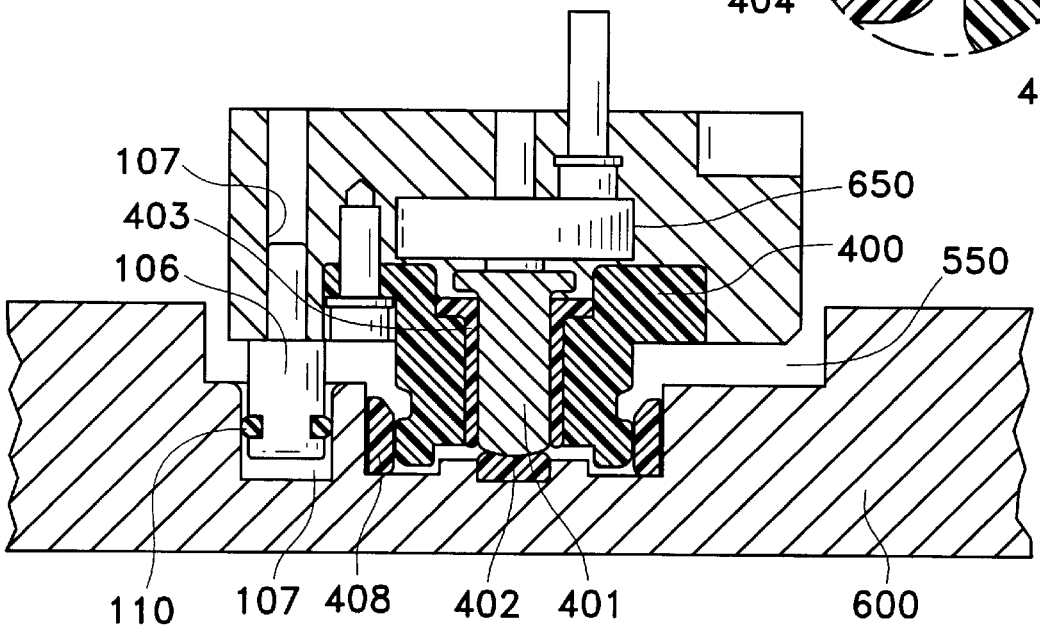
FIG. 5 is a cut-away, sectional view of the dual radius gimbal bearing shown in FIG. 4.

FIG. 5 shows the dual radius gimbal system discussed above with regard to FIGS. 4A and 4B. Puck 400 and an upper portion of the hollow in substrate plate 600 define a socket 550 which is preferably filled with grease or other lubricant to further reduce the friction experienced during gimballing.

Contact pin 401 is slidably mounted within a low friction sleeve 403 which is fixed ( preferably press fit) within puck 400. This enables an even better isolation of the vertical forces transferred between the substrate plate 600 and load cell 650 which is mounted directly on top of contact pin 401. The placement of the load cell 650 allows the system to decouple the hysteresis effects which would otherwise be generated by the load assembly components.

Further, due to the alignment of the horizontal and vertical contact forces so as to be coplanar, the effective gimbal location can be moved much closer to the actual polishing surface of the substrate plate, as indicated by H in FIG. 4A. The distance H is less than the radius of curvature of surfaces 402 and 404, which would be the limiting distance from the polishing surface if a standard gimbal ball were to be used. Also, due to the hollow formation in the substrate plate 600, the distance H is much less than the thickness T of the substrate plate 600.

Figure 13:
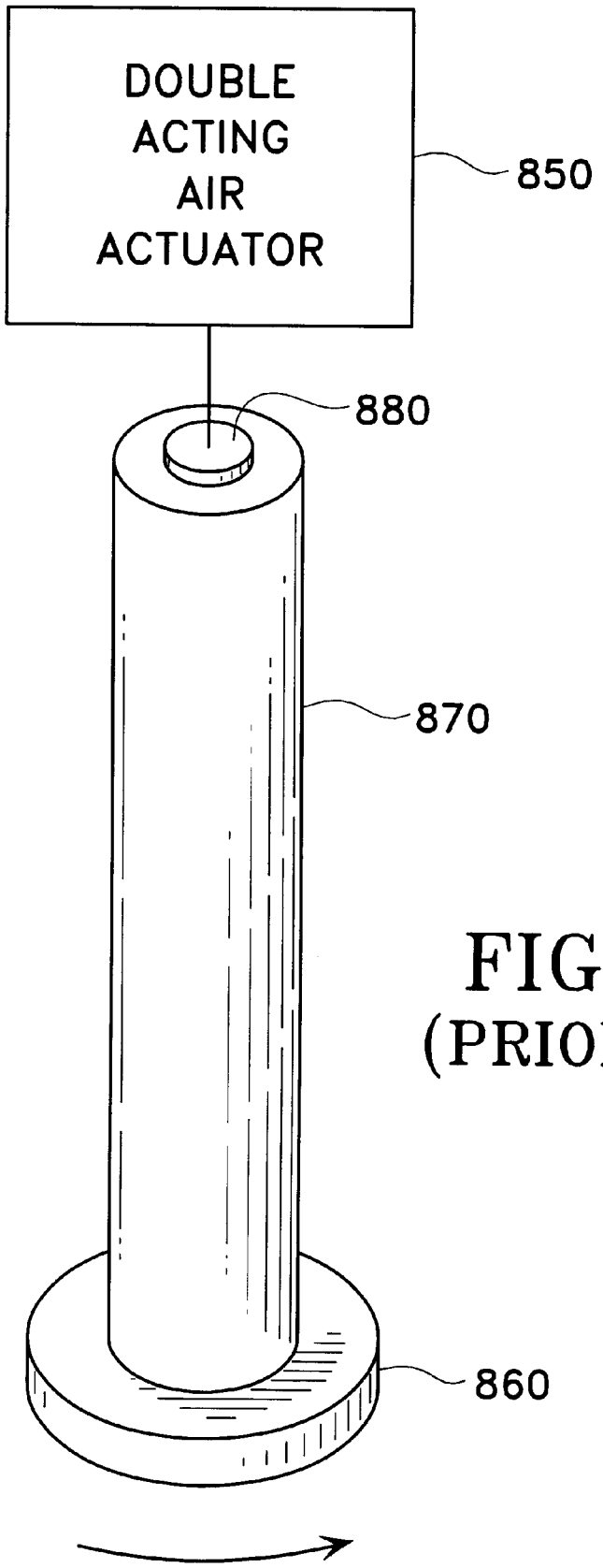
FIG. 13 (PRIOR ART)
FIG. 13 is a schematic drawing of a conventional rotary polishing apparatus.

Referring to FIG. 13, a conventional rotary substrate carrier is diagrammed. In this type of arrangement, a double acting air actuator 850 is provided for application of both vertical down force on the substrate carrier 860, as well as a rotational driving force for the substrate carrier 860. A heavy drive coupling shaft 870 is also required for transfer of the dual actions to the substrate carrier. The drive coupling shaft alone generally weighs on the order of 50 to 500 pounds. Multiple bearing mounts are required for mounting the shaft 870 between the actuator 850 and substrate carrier 860. A feedback load cell 880 is provided atop the shaft 870 for indicating a measure of the amount of vertical load which is applied to the substrate at the location of the substrate carrier 860 at any given time. However, in this type of arrangement, because the spinning, heavy shaft 870 intervenes between the load cell 880 and the actual location of the load applied to the substrate, the load cannot be directly measured on the substrate carrier 860 itself since the substrate carrier spins during processing. The location of the load cell 880 above the rotating shaft makes force measurements inaccurate, since a substantial amount of hysteresis is generated by the heavy, spinning shaft, as well as the rotation of the substrate carrier.

In contrast, the load system between load cell 650 and the actual location of the force applied to the substrate in the system according to the present invention weighs only about 5.5 pounds. Since neither the substrate plate 600 nor contact pin 401 (or gimbal 400,) rotates, the load cell 650 can be directly mounted atop the substrate plate/gimbal, thereby decoupling the hysteresis effects described above with respect to the conventional rotating substrate carrier and required shaft. Thus, a much more accurate measurement of the vertical force is obtained by the present arrangement. The same advantages are obtained in the additional embodiments which are discussed below. Of course, the inventive gimbal arrangements can also be practiced with a conventional location of a load cell.

Figure 6:
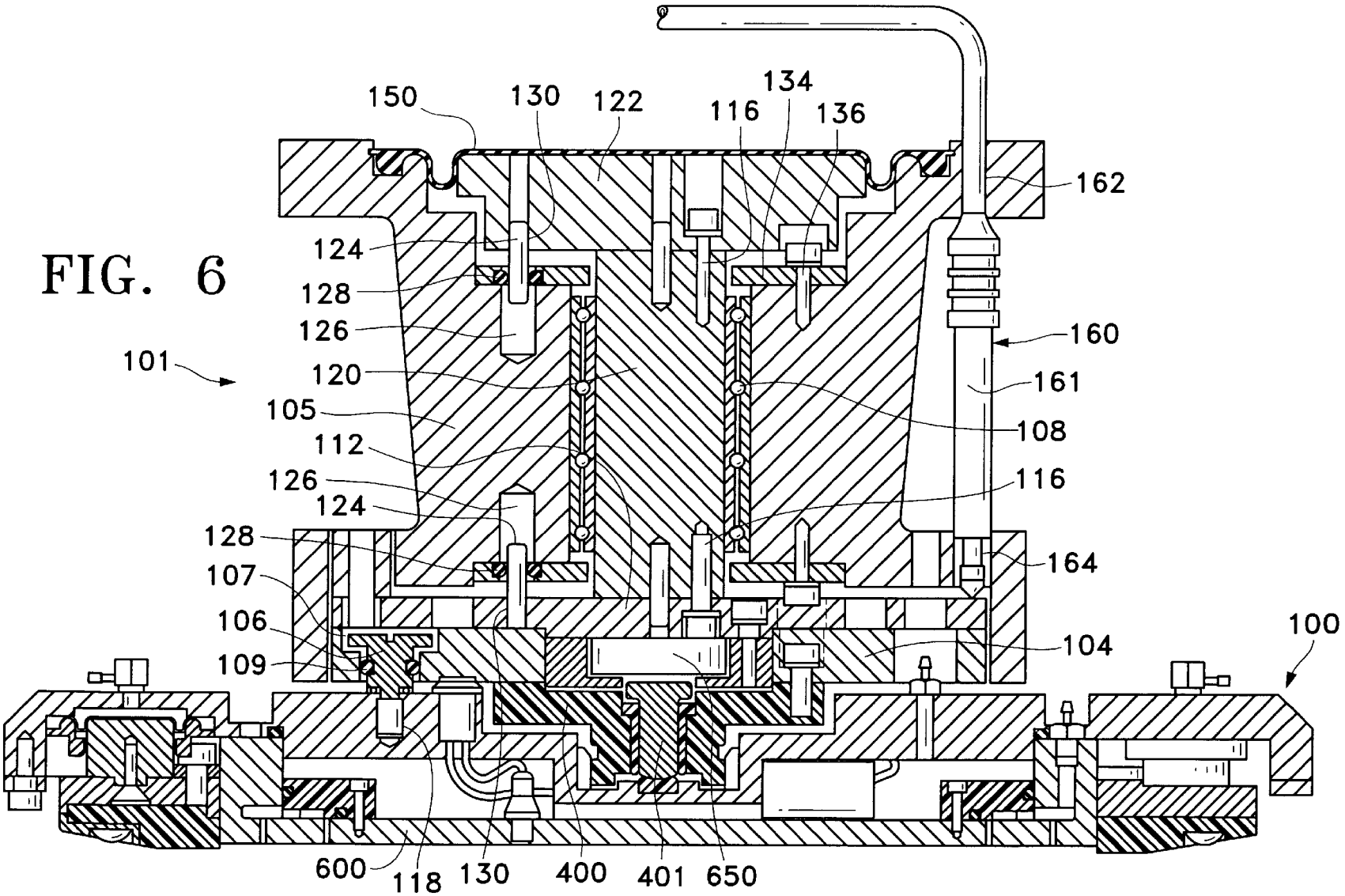
FIG. 6 is a sectional view of a substrate carrier for a CMP apparatus employing a gimbal arrangement as shown in FIG. 5.

FIG. 6 is a sectional view of a polishing apparatus 101 showing a mounted substrate carrier 100 which employs the dual radius gimbal arrangement described in FIG. 5. Substrate carrier 100 is mounted to chuck 104 which in turn is mounted to bearing housing 105 of the polishing apparatus 101. Substrate carrier mount 100 is preferably mounted to chuck 104 by bolts but other equivalent forms of mounting may be employed as would be readily apparent to those of ordinary skill in the art. Similarly, chuck 104 may be bolted, threaded or otherwise mounted to bearing housing 105.

Puck 400 is mounted to chuck 104 (preferably by bolting) and, together with contact pin 401 and the contact surfaces described above, allows substrate carrier 100 to tilt and pivot with respect to chuck 104. At least one antirotation pin 106 is provided to prevent rotation of substrate carrier 100 with regard to chuck 104. Thus, although tilting of the substrate carrier 100 with respect to chuck 104 about two axes will still be allowed by gimbal 108, the antirotation pin or pins 106 prevent any substantial rotation of substrate carrier 100 about its central axis, with respect to chuck 104. Preferably, three antirotation pins 106 are circumferentially provided at equally spaced intervals of about 120° around the center of chuck 104. However, more or fewer antirotation pins may be used.

Antirotation pin 106 is slidably mounted within a bore 107 in chuck 104, to allow vertical movements of the antirotation pin with respect to the chuck. Antirotation pin 106 may be driven in a vertical direction upon tilting of substrate carrier 100 with respect to chuck 104. O-ring 109 provides a snug fit between antirotation pin 106 and bore 107 while still allowing pin 106 the freedom of vertical movement. Antirotation pin 106 is securely fixed in substrate carrier 100, preferably by threading into a threaded hole 118 of substrate carrier 100, although other equivalent methods of secure fixation may be employed.

A diaphragm 150 is seated atop bearing housing 105 and forms a seal therewith. Bearing housing 105 is further mounted to a vertical force applicator (not shown), which is preferably an air cylinder or hydraulic cylinder, which can be computer controlled for precise feedback control of the applied force. Piston column 120 is slidably mounted within bearing housing 105 via linear bearing 108. Pressure plate 112 is mounted to chuck 104 via screws preferably or bolts (not shown), and transfers downward vertical forces from the piston column 120 to the substrate carrier 100 via load cell 650 and contact pin 401. Air cylinder 122 mates with the underside of diaphragm 150 and contacts the upper end of piston column 120. Upon actuation of the vertical force applicator, diaphragm 150 distends, thereby transferring the vertical force to air cylinder 122 which in turn moves piston column 120 in a downward direction to apply vertical force to the substrate carrier 100 through pressure plate 112, load cell 650, contact pin 401 and button 402.

Antirotation pins 116 are mounted between pressure plate 112 and piston column 120, and piston column 120 and air cylinder 122, respectively, to substantially prevent rotation of the piston column 120 so as to limit application of forces to substantially normal downward translatory forces, thereby improving the accuracy of force measurement. Linear bearing 108 substantially reduces friction between the piston column 120 and bearing housing 105 during movement of the piston column 120 to transfer vertical forces, thereby greatly reducing hysteresis effects. Linear bearing 108 is mounted within bearing housing 105, preferably by mounting clamps 134, which are bolted to bearing housing 105 via bolts 136 or other equivalent mounting hardware.

Antirotation pins 124 are mounted between pressure plate 112 and bearing housing 105, and bearing housing 105 and air cylinder 122, respectively, to substantially prevent rotation of the pressure plate and air cylinder, which, in turn prevent rotation of the piston column 120 via antirotation pins 116, described above. Antirotation pins 124 are each slidably mounted within a bore 126 in bearing housing 105, to allow vertical movements of the antirotation pins 124 (as well as the air cylinder 122 and pressure plate 112) with respect to the bearing housing 105 during vertical movements of the piston column 120. O-rings 128 provide a snug fit between antirotation pins 124 and bore 126 while still allowing pins 124 the freedom of vertical movement. Antirotation pins 124 are securely fixed in air cylinder 122 and pressure plate 112, respectively, preferably by threading into threaded holes 130, although other equivalent methods of secure fixation may be employed.

The piston column and associated vertical force application hardware discussed above is designed for the application of downward force upon the substrate carrier 100 and, ultimately, the substrate to be polished/planarized. Accordingly, only a very small range of vertical displacement or travel is actually required by the piston column 120. At the beginning of a substrate conditioning procedure, it is preferred that the piston column 120 be located substantially in the middle of its range of vertical travel, to enable it to have the ability to move either upward or downward as needed. Sensor 160 is provided for providing reliable feedback as to the positioning of piston column 120 with respect to its vertical travel limits, thereby enabling the operator to position the piston column 120 at the center of its travel to begin processing.

Sensor 160 is fixedly mounted within a bore 162 in bearing housing 105, preferably by threading or other equivalent fixation. A feedback line (preferably an electrical connection) runs from the sensor to a controller (not shown) which interprets a feedback signal from the sensor 160 and converts the signal to a measurement of the position of piston column 120 with respect to its travel limits. Sensor 160 is preferably a linear voltage displacement transducer, although other equivalent sensors are available and may be used as a substitute. Sensor 160 includes travel probe 164 which slides in and out of the main housing of sensor 160 and generates a signal which is proportional to the amount of distance that the travel probe 164 extends from the main housing 161. The tip of travel probe 164 abuts against pressure plate 112. As piston column 120 moves either upward or downward, pressure plate 112, which abuts the piston column 120 moves with it, by an equal distance. Travel probe 164 directly measures the travel of pressure plate 112, which also provides an accurate measurement of the travel of piston column 120.

Figure 7:
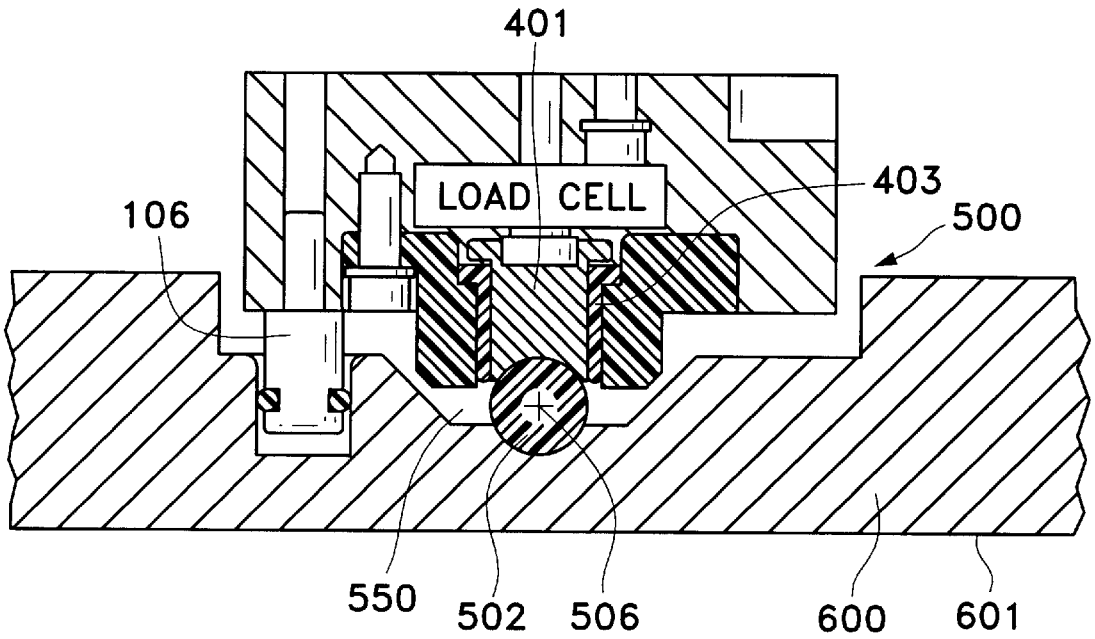
FIG. 7 is a sectional view of another embodiment of a gimbal according to the present invention.

FIG. 7 shows another embodiment of an improved gimbal arrangement according to the present invention. Although this embodiment employs a full spherical gimbal ball, the pivot point is lower than a conventional gimbal system because of the advantages inherent in the substrate plate according to the present invention. Because the substrate plate 600 does not rotate, the substrate plate may be made hollow, thereby allowing gimbal ball 502 to be embedded within the substrate plate 600 at a much closer distance to the polishing surface than is conventional.

The pivot point of gimbal system 500 is defined by the point where horizontal and vertical forces intersect, i.e., the point defined by reference numeral 506 ( the center of gimbal ball 502). Thus, the height or distance H affecting the moments formed in this system, although greater than the radius of the gimbal ball 502, is nevertheless significantly less than the thickness of the entire substrate plate 600, owing to the hollow design of the substrate plate 600 used in such a system.

Figure 8:
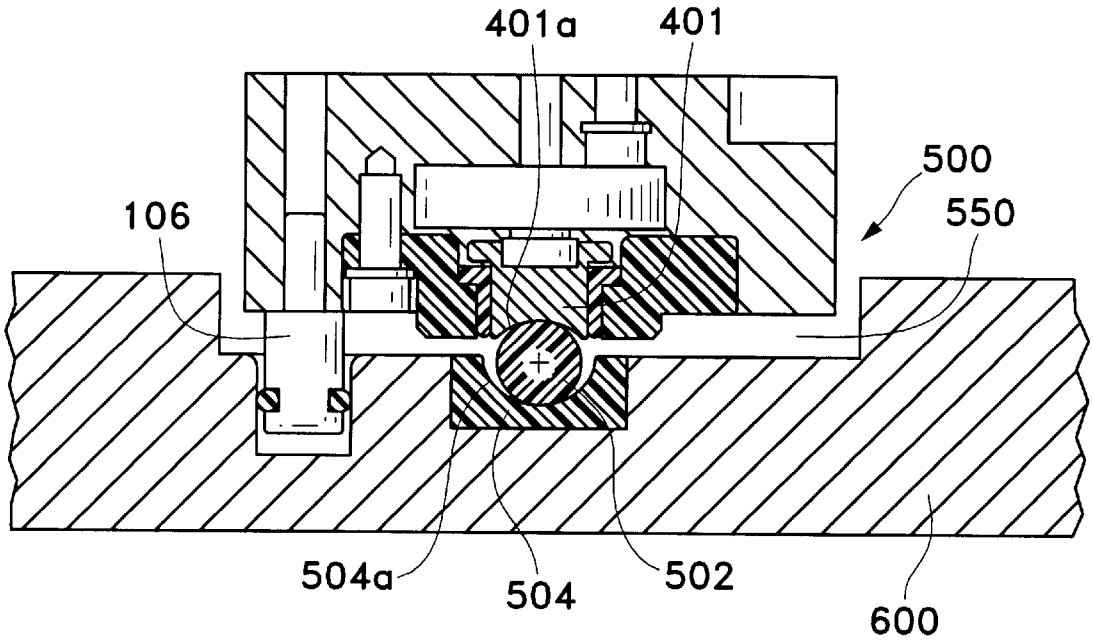
FIG. 8 is an enlarged cut-away sectional view of the puck and bearing surfaces of the gimbal shown in FIG. 7.

FIG. 8 is a sectional view of the embodiment shown in FIG. 7, which better shows the relationship between gimbal ball 502 and bearing surfaces 504*a* and 401*a*. The radii of curvature of the bearing surfaces 504*a* and 401*a* are substantially equal to one another and larger than the radius of curvature of gimbal ball 502. As the substrate carrier 100 is moved through a polishing pattern (preferably an orbital pattern, but an infinite number of patterns are available), the gimbal ball 502 being smaller than the socket defined by surfaces 504*a* and 401*a* rolls and precesses, much like the motion of a planetary gear or spirograph.

Because of the rolling ability of gimbal ball 502, this gimbal arrangement is not bound by the static friction inherent in a conventional gimbal ball pivot assembly, but rather experiences lower frictional forces in the form of rolling friction. Additionally, because of the lower positioning of gimbal ball 502 with respect to the polishing surface 601, significantly smaller moments are generated about the gimbal point during polishing, thereby significantly reducing the "nose-diving" phenomenon.

As further shown in FIG. 8, the bearing surface 504*a* is provided by the socket 504. Socket 504 is fixed, preferably press fit, within the hollow portion of substrate plate 600. Of course, other equivalent methods of fixing the socket 504 into the substrate plate may be used, such as the use of adhesives, screws, friction welding, etc. Socket 504 is preferably formed of DELRIN, or another substantially equivalent linear acetyl resin. Other suitable low friction plastics include polyphenko ertalyte. Still further, other low friction materials such as ceramics may be successfully employed. Additionally, socket 504 may be made of metal such as stainless steel, aluminum, brass, etc., and coated with one of the aforementioned plastics or ceramics to form the bearing surface 504*a*. As in the previously discussed embodiment, the substrate plate 600, puck 500 and contact pin 401 are preferably formed of stainless steel, more preferably hardened stainless steel, but other metals having sufficient strength and wear resistance, such as aluminum or brass, for example, may be alternatively used. However, in this embodiment, the contact pin includes a bearing surface 401*a* which interfaces with gimbal ball 502. Bearing surface 401*a* is preferably formed of the same material as bearing surface 504*a*.

The arrangement of one or more antirotation pins 161 is also provided with this embodiment and is the same as described above with respect to the embodiment shown in FIG. 5. The puck 500 and upper portion of the hollow in substrate plate 600 define a socket 550 which is preferably filled with grease or other lubricant to further reduce the rolling friction experienced by gimbal ball 502 during gimballing.

Figure 9:
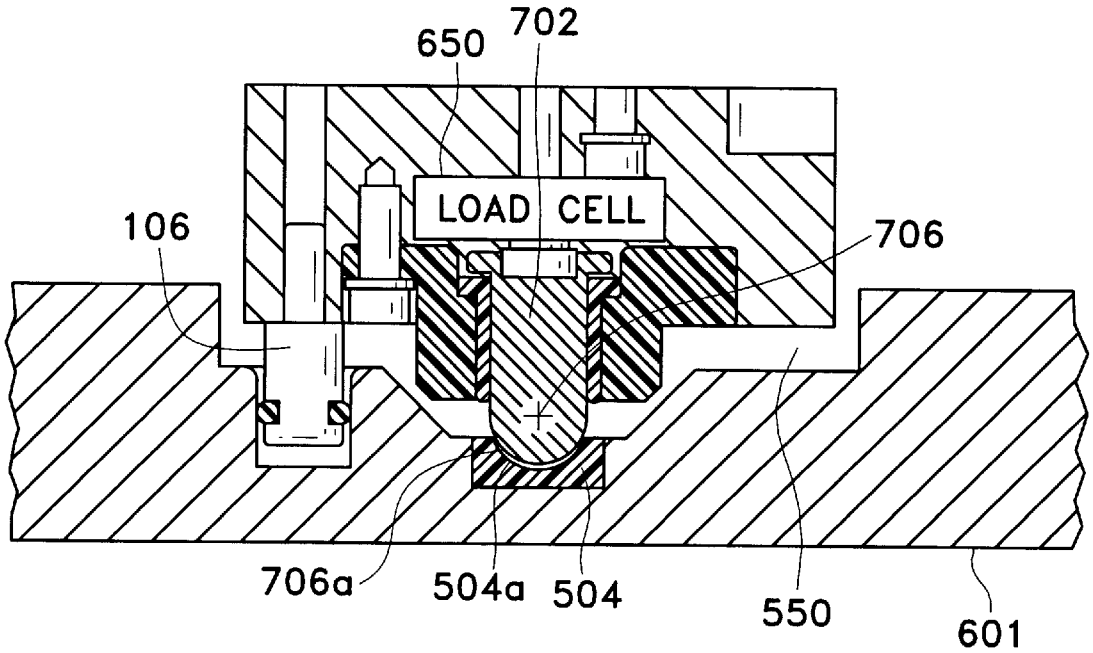
FIG. 9 is a sectional view of a third gimbal arrangement according to the present invention.

FIG. 9 shows another embodiment of an improved gimbal apparatus according to the present invention. This embodiment shares the low profile advantages discussed above with regard to the embodiment shown in FIGS. 7 and 8, i.e., because of the lower positioning of the gimbal point 706 with respect to the polishing surface 601, significantly smaller moments are generated about the gimbal point during polishing, thereby significantly reducing the "nose-diving" phenomenon.

The socket 504 and bearing surface 504*a*, as well as the arrangement of one or more antirotation pins 106, and grease socket 550 are also provided with this embodiment and are the same as described above with respect to the embodiment shown in FIGS. 7 and 8. This embodiment differs, however, in that the gimbal ball 502 and contact pin 401 of FIG. 8 have been integrated into one component 702. This eliminates the bearing interface between bearing surface 401*a* and gimbal ball 502 in the previous embodiment. The effect of this arrangement is that contact pin 702 does not roll as effectively as gimbal ball 502. However, this embodiment has the advantage of reducing a certain amount of vibration during polishing processes. Friction reduction is achieved, with regard to conventional gimbal arrangements, by the provision of bearing surface 504*a* having a larger radius of curvature than the radius of curvature of the end of contact pin 706*a*. Contact pin 706 and end 706*a* are preferably formed of hardened stainless steel, or other equivalent metals as discussed above with regard to other embodiments of gimbal balls and contact pins.

A load cell 650 is provided directly above contact pin 706 to achieve the same direct feedback benefits as described above with regard to load cells used in other embodiments of the present invention.

Figure 10:
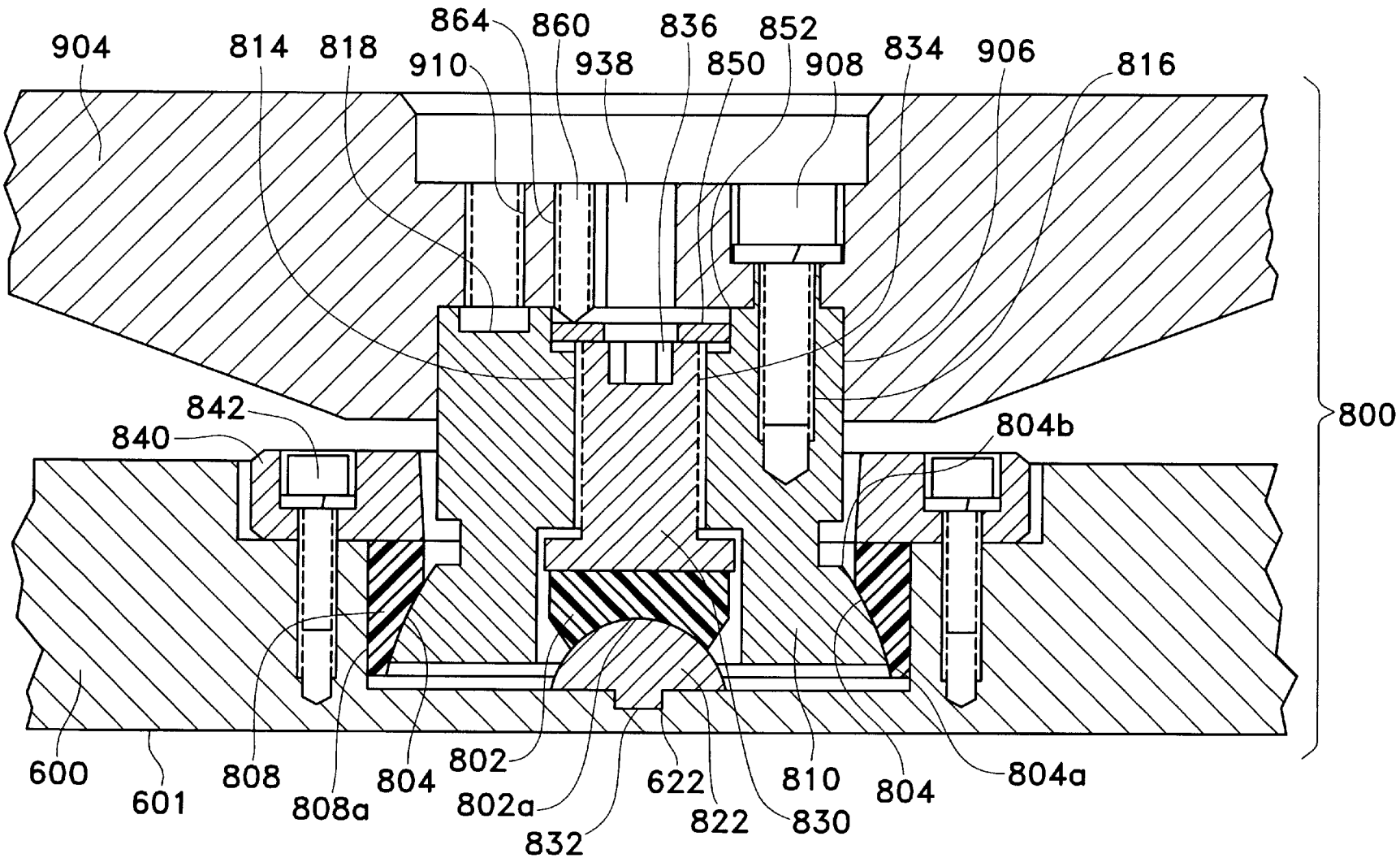
FIG. 10 is a partial sectional view of an adjustable gimbal arrangement taken along section lines X—X shown in FIG. 12.
Figure 11:
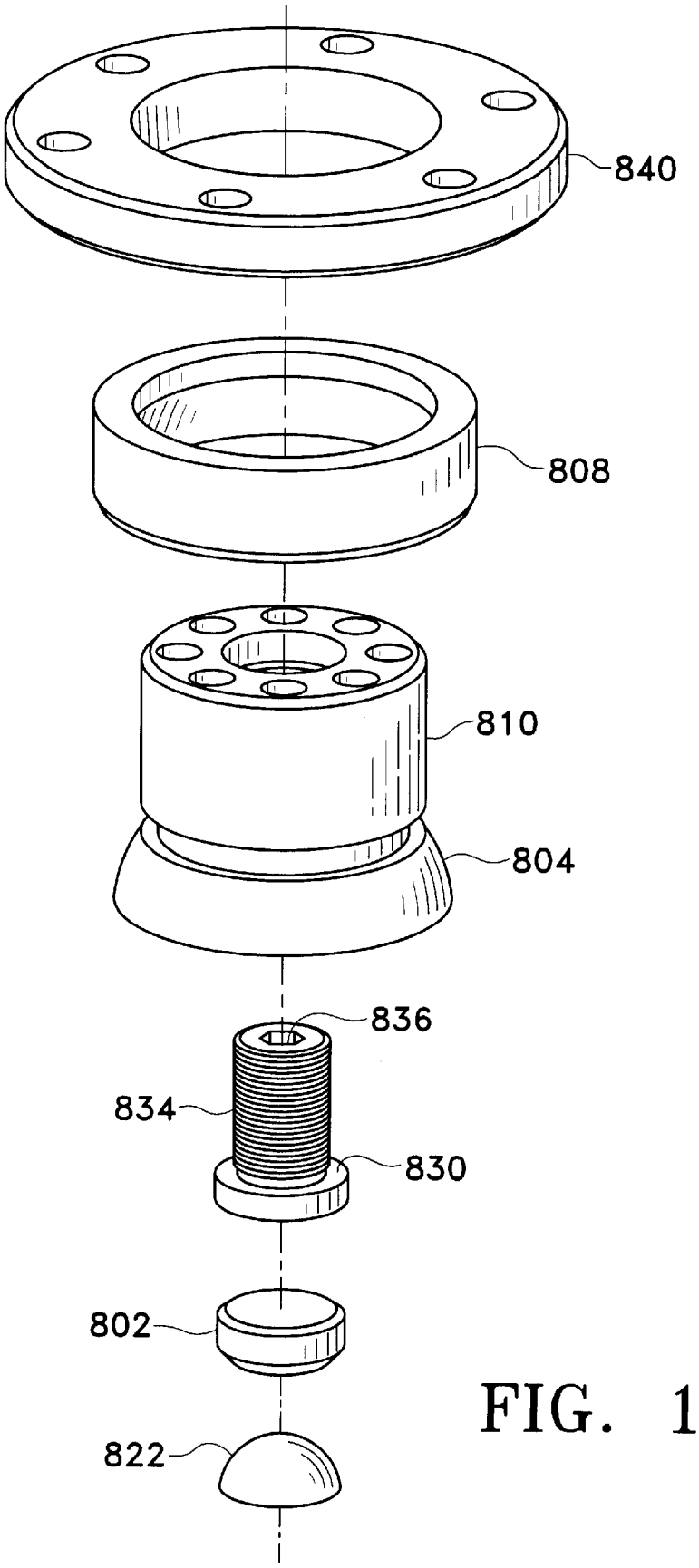
FIG. 11 is an exploded view of an adjustment assembly used in the gimbal arrangement shown in FIG. 10.
Figure 12:
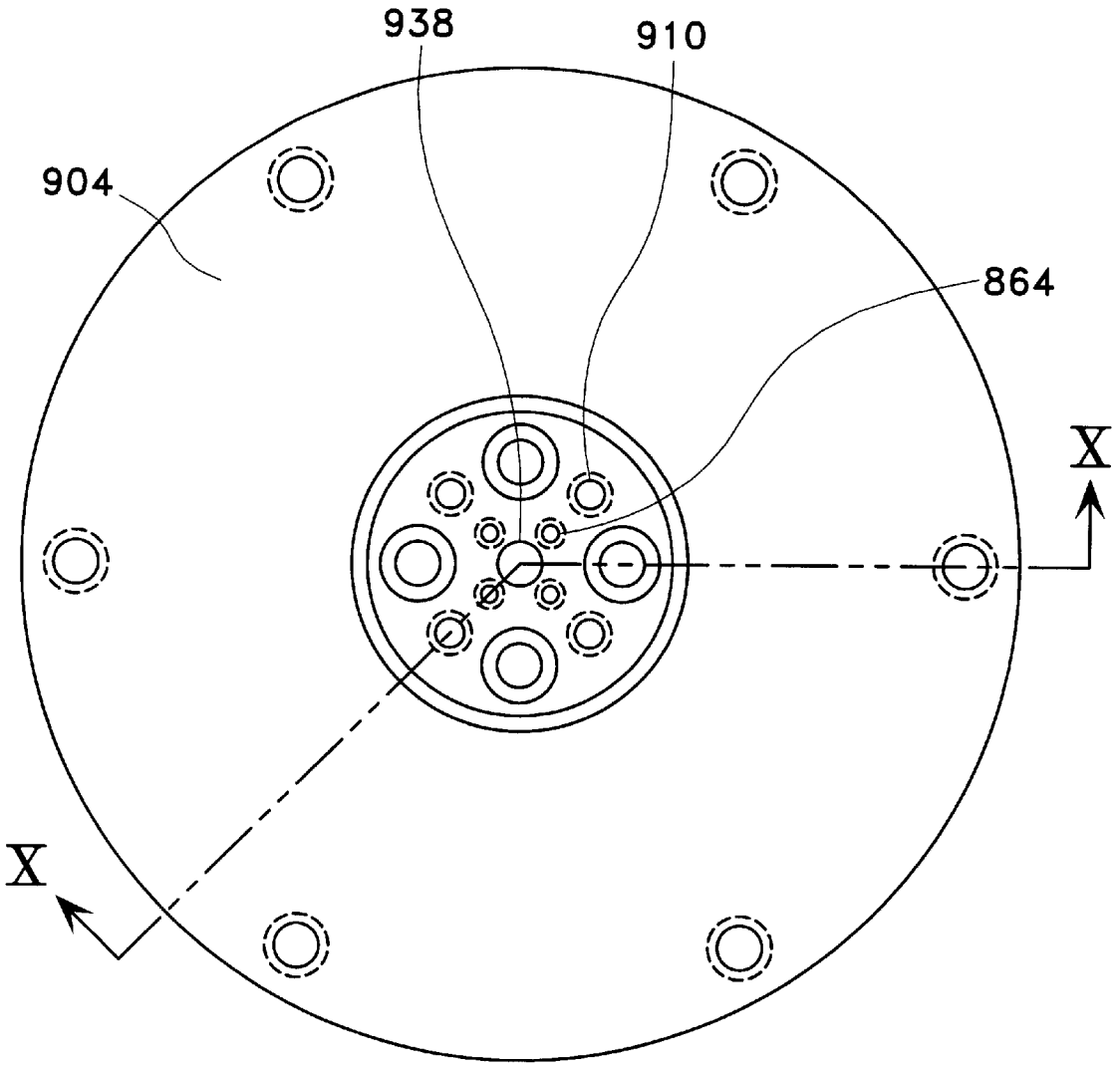
FIG. 12 is a top view of a carrier mount or chuck component of a gimbal arrangement according to the present invention.

FIG. 10 is a partial sectional view of an adjustable gimbal system 800 according to the present invention. In the course of polishing, an ideal gimbal system would be frictionless so as not to induce any moments upon the polishing apparatus during the gimballing motion. The gimbal system would also ideally exhibit infinite stiffness so as not to be subject to the generation of any instabilities leading to vibrations during polishing. In reality, there is unfortunately a trade off between friction and stiffness in all gimbal designs, that is, as the stiffness of the system is increased, the friction between the moving parts of the system also increases concomitantly.

The embodiment of FIG. 10 allows adjustment of the gimbal mechanism 800 so as to arrive at an optimum balance between friction and stiffness during gimballing while polishing. That is, an optimum range of stiffness versus friction can be dialed in to the system so as to remove unwanted vibrations during polishing, while maintaining friction in the gimbal system at sufficiently low values so as not to significantly effect the planarity of the polishing motions applied to the substrate being polished. Interestingly, the stiffness-friction balance is not always the same, as optimum values may change depending upon the type of polishing media that is used for the polish, the amount of pressure applied through the carrier during polishing, the stage of polishing that is being conducted (e.g., early stage as opposed to a finish stage), among other variables.

Additionally, a certain amount of wear inevitably occurs in a gimbal system as the number of hours of polishing without replacing parts increases. As wear occurs, obviously the moving parts "loosen up" as the tolerances therebetween increase. This has a tendency to decrease the stiffness of the system to the point where counterproductive vibrations may begin to occur.

The embodiment of FIG. 10 provides the capability of eliminating vibrations by enabling the tolerances to be adjusted back down as wear occurs, to stiffen up the mechanism. Also, the gimbal system in FIG. 10 can be tuned to a specific stiffness-friction setting which is optimal for a particular set of parameters that are used in a specific polishing process. These settings will vary depending on whether a finishing polish or a more course procedure is taking place, whether slurry or a slurryless polishing medium is being employed, and amount of polishing down force, among a myriad of other variables.

The shape of the puck or gimbal shaft 810 is generally similar to the shape of the puck 400 of the embodiment shown in FIG. 4A for the reasons provided in the description of puck 400 above. For example, the bearing surfaces of horizontal force gimbal surface 804 contact the low friction lateral contact ring 808 at a height above the polishing surface which is substantially coplanar with the location of contact between the vertical force gimbal surface 802*a* of the normal contact button 802 with vertical gimbal support 822.

As mentioned above with regard to FIG. 3, the theory behind the arrangement of the gimballing surfaces so as to be substantially coplanar is that by moving the vertical point of contact of a standard gimbal ball up to a position of horizontal alignment with the horizontal gimbal contacts, the height of the pivot point above the polishing surface is substantially reduced, thereby substantially reducing induction of moments about the pivoting location during polishing. At the same time, the effective radius of the "ball" (i.e., gimbal) 800 remains large (i.e., the same as that of the standard gimbal ball) in the horizontal direction to distribute horizontal stress levels.

Additionally, in the embodiment of FIG. 10, the contact surfaces 808*a* and 802*a* are substantially concentric about a point 832 which is significantly lower than the actual heights of the locations of contact. Consequently, the center of rotation of the gimbal system 800 is projected downward to the location 832, further minimizing any tendency of the system to induce moments during polishing.

Another significant feature of the system 800 is that the gimbal shaft 810 includes bearing surfaces of horizontal force gimbal surface 804 which are formed in the shape of a portion of a sphere with the lower edge 804*a* of the surface 804 extending radially further from the central axis C—C of the gimbal shaft than the upper surface 804*b*. Low friction lateral contact ring 808 is provided with a surface 808*a* that is shaped as a frustum of a cone and mates with gimbal surface 804 for transferring lateral forces between the substrate plate or carrier mount 600 and the horizontal force gimbal surface 804. The surface of contact 808*a* is formed substantially as a true frustum of a cone, while the contact surface 804 on the other hand, is formed substantially as a portion of a sphere, as noted above, and has a radius of curvature substantially about the point 832, as described above.

The spherical formation of the surface 804 and the tapered formation of the surface 808*a* allows for the adjustment of the system 800 so as to adjust the interference fit between the moving parts to fine tune and balance the trade off between friction and susceptibility to vibration, as described above. The angle of the surface 808*a* is preferably about 15 degrees to vertical, although other angles can be employed to achieve adjustability of the gimbal system as desired. An adjuster 830 contacts the normal contact button 802 and is vertically adjustable so as to control the relative vertical positioning between the gimbal shaft 810 and normal contact button. Any adjustments made by the adjuster 830 are of course, relatively minor (i.e., on the scale of thousandths of an inch) thereby serving to adjust the tolerances between the moving surfaces without substantially effecting the coplanarity of the vertical and horizontal gimbal surfaces.

The adjuster 830 is externally threaded 834 to engage with mating threads 814 within the gimbal shaft 810. Threads 834 and 814 are preferably very fine, most preferably on the order of about 80 tpi (threads per inch) so that a turn of the adjuster 830 translates the adjuster vertically with respect to the gimbal shaft 810 by a very minute amount. The top end of the adjuster is formed to receive a tool at 836 for application of force to turn the adjuster in making the adjustments. Preferably, fitting 836 is adapted to mate with a hex or Allen type wrench, but of course, alternative fittings such as screw heads, standard bolt head patterns or special or custom designs may be employed to fit with a particular driving tool.

In assembly, the vertical support button 822 is positioned in a central recess 622 formed in the substrate plate 600 and normal contact button 802 is placed on top of the vertical support. The adjuster 830 is threaded into the gimbal shaft 810 into a position that roughly approximates where it will be positioned during polishing. The lateral contact ring 808 is placed into position over and the subassembly of the adjuster 830, and gimbal shaft 810 and is then appropriately positioned in the cavity provided in the substrate plate 600. The adjuster 830 aligns with the normal contact button 802 which is atop the vertical support surface 822. With the subassembly in place, a retainer 840 is positioned to overly the ring 808 and a shoulder of the substrate plate 600. The retainer 840 is anchored to the substrate plate 600 via bolts 842 or other equivalent fixation devices.

The fixation of the retainer 840 securely fixes the ring 808 into position within the cavity of the substrate plate 600, so that only the gimbal shaft 810 is movable with respect to the ring 808, while the ring 808 remains fixed. After fixation of the subassembly, the top portion of the gimbal shaft 810 is next fixed into the carrier mount or chuck 904.

The dimensions of the cavity 906 in the chuck and the gimbal shaft 810 are such as to provide an interference fit between the two. Screws or bolts 908 are threaded into the mating threaded holes 816 and are sequentially torqued so as to draw the gimbal shaft 810 into a press fit with the cavity 906. A pattern of countersunk holes 818 are provided in the top of the gimbal shaft 810 to enable disassembly thereof. Threaded jack holes 910 are aligned with the holes 818 to allow a threaded jack rod or bolt (not shown) to be threaded into each of the holes to provide a driving force to, after removal of bolts or screws 908, push the gimbal shaft 810 out of its press fit position within the cavity 906.

Once the bolts or screws 908 have been sufficiently torqued to securely position the gimbal mechanism as described above, a fine adjustment of the gimbal surfaces is performed to optimize the gimbal performance for a particular polishing process. A mating tool (not shown) is passed through the opening 938 of the chuck 904 to engage tool fitting 836, at which time an operator rotates the tool either clockwise or counterclockwise, accordingly. This motion either advances the adjuster 830 against the contact button 802, thereby increasing the pressure thereagainst, or vice versa, i.e., rotation in the opposite direction will withdraw the adjuster from the contact button, thereby relieving pressure.

Movement of the adjuster 830 toward and against the contact button 802 creates a force against the vertical support button 822, and an equal and opposite force back through the contact button 802 and adjuster 830. Continued advancement of the adjuster 830 against the contact button causes an upward vertical movement of the adjuster 830 and consequently the gimbal shaft 810 with respect to the contact button 802, vertical support surface 822 and substrate plate 600. Since, as discussed above, the lateral contact ring 808 is also fixed with respect to the substrate plate, the effect is that the surface 804 slides upwardly against the ring 808, thereby decreasing the tolerance fit between the two surfaces. At the same time, the tolerance fit between the contact button 802 and vertical support surface 822 is decreased. Accordingly, an appropriate balance between tolerances among the sliding surfaces of the gimbal system, and friction induced thereby can be dialed into the system using the adjuster as discussed. The interface between the adjuster 830 and the contact button 802 is a sliding surface to prevent any stress concentration in this portion of the gimbal system during gimballing motions. Alternatively, the contact button could be formed integrally with the adjuster, although this is not the preferred arrangement.

Once the tolerances between the gimballing surfaces have been adjusted as desired, a locking mechanism is set to lock the adjuster 830 in its position relative to the gimbal shaft 810. A flat washer 850 or other equivalent structure for the application of a locking force is mounted on the adjuster as shown in FIG. 10. The washer 850 is provided with a central opening dimensioned to allow free access to the tool fitting 836, so that the washer need not be removed during adjustment of the gimbal. In a preferred embodiment, set screws 860 are provided to pass through threaded set screw holes 864 in the chuck 904 and opening 852 in the gimbal shaft, so as to contact washer 850. Preferably a four hole pattern is provided as shown, although more or fewer set screws could be used. Torquing of the set screws 860 against the washer 850 effectively locks the adjuster 830 in position with respect to the gimbal shaft 810 and washer 850. Alternate locking mechanisms could also be used. For example, among other alternatives, rather than a washer 850, a pair of threaded members could be threaded in place in the opening 852 to act as locking nuts against the end of the adjuster 830.

Ring 808 and contact button 802 are preferably formed of low friction plastic, which is made possible by the fairly large radii of curvature of the respective contact surfaces. Ring 808 and button 802 are most preferably formed of DELRIN AF (a Teflon filled DELRIN) or DELRIN, or another substantially equivalent linear acetyl resin. Other suitable low friction plastics include polyphenko ertalytes. Still further, other low friction materials such as ceramics may be successfully employed. The vertical support button 822 and gimbal shaft 810 are preferably formed of stainless steel, more preferably hardened stainless steel, but other metals having sufficient strength and wear resistance, such as aluminum or brass, for example, may be alternatively used.

At least one anti-rotation pin 106, as shown in FIG. 5, is provided to prevent rotation of substrate carrier 600 with regard to chuck 904 during polishing and gimballing movements. Preferably, a single anti-rotation pin is used. However, any number of pins may be used. For example, three anti-rotation pins may be circumferentially provided at equally spaced intervals of about 120° around the center of chuck 904.

The foregoing detailed description is illustrative of several embodiments of the invention, and it is to be understood that additional embodiments thereof will be obvious to those of ordinary skill in the art. Those modifications and equivalents which fall within the spirit of the invention are to be considered a part thereof.

What is claimed is:

1. A low profile gimbal system, comprising:

a carrier mount;

a gimbal shaft;

a first bearing surface disposed on a first portion of the carrier mount;

a second bearing surface disposed on an outer surface of the gimbal shaft which engages the first bearing surface;

a third bearing surface disposed on a second portion of the carrier mount; and a fourth bearing surface disposed on a lower surface of the gimbal shaft which engages the third bearing surface.

2. The gimbal system of claim 1, wherein the third bearing surface comprises a concave conical portion and the fourth bearing surface comprises a convex spherical portion.

3. The gimbal system of claim 1, wherein the third bearing surface comprises a convex spherical portion and the fourth bearing surface comprises a concave conical portion.

4. The gimbal system of claim 1, wherein the fourth bearing surface is integral with the gimbal shaft.

5. The gimbal system of claim 1, wherein the gimbal shaft is vertically aligned along a substantially vertical central axis and the first bearing surface tapers away from the central axis from a top to a bottom of the surface.

6. The gimbal system of claim 5, wherein the first bearing surface tapers at an angle of about 15 degrees from the central axis.

7. The gimbal system of claim 1, wherein the second bearing surface comprises a portion of a spherical surface.

8. The gimbal system of claim 1, wherein the engagement of the first bearing surface and the second bearing surface is substantially co-planar with the engagement of the third bearing surface and the fourth bearing surface.

9. The gimbal system of claim 1, further comprising an adjuster disposed within the gimbal shaft.

10. The gimbal system of claim 9, wherein downward movement of the adjuster with respect to the gimbal shaft simultaneously forces the second bearing surface against the first bearing surface and the third bearing surface against the fourth bearing surface.

11. The gimbal system of claim 9, further comprising a locking mechanism abutting a top surface of the adjuster.

12. The gimbal system of claim 11, wherein the locking mechanism comprises a washer and at least one threaded member having a screw or bolt disposed therein, wherein torquing of the threaded member binds the washer against the adjuster to prevent movement of the adjuster with respect to the gimbal shaft.

13. A low profile adjustable gimbal system comprising:

a first bearing surface adapted to be mounted to a first portion of a carrier;

a gimbal shaft having a second bearing surface which engages the first bearing surface;

a third bearing surface adapted to be mounted to a second portion of the carrier;

a fourth bearing surface which engages the third bearing surface; and an adjuster movably mounted to the gimbal shaft;

wherein movement of the adjuster with respect to the gimbal shaft varies tolerances between the first and second bearing surfaces, and between the third and fourth bearing surfaces, simultaneously.

14. The gimbal system of claim 13, further comprising a locking mechanism abutting the adjuster.

15. The gimbal system of claim 14, wherein the locking mechanism comprises a washer abutting a top surface of the adjuster, and having at least one threaded member, wherein torquing of the threaded member binds the washer against the adjuster preventing movement of the adjuster with respect to the gimbal shaft.

16. The gimbal system of claim 15, wherein the at least one threaded member comprises at least one set screw.

17. The gimbal system of claim 15, wherein the locking member comprises four set screws threadably engaged against the washer.

18. The gimbal system of claim 13, wherein the gimbal shaft is vertically aligned along a substantially vertical central axis and the first bearing surface tapers away from the central axis from a top to a bottom of the surface.

19. The gimbal system of claim 13, wherein the first bearing surface tapers at an angle of about 15 degrees from the central axis.

20. The gimbal system of claim 3, wherein the second bearing surface comprises a portion of a spherical surface.

21. The gimbal system of claim 13, wherein downward movement of the adjuster with respect to the gimbal shaft forces the fourth bearing surface against the third bearing surface.

22. The gimbal system of claim 13, wherein the adjuster is vertically movable with respect to said gimbal shaft, and wherein vertical movement of the adjuster downward with respect to the gimbal shaft forces the second bearing surface against the first bearing surface.

23. The gimbal system of claim 13, wherein the adjuster threadably engages the gimbal shaft.

24. The gimbal system of claim 13, wherein the second, third, and fourth bearing surfaces each comprise a concentrically arranged radius of curvature.

25. The gimbal system of claim 24, wherein the radii of curvature are concentrically arranged about a point substantially below the gimbal system, wherein the center of rotation of the gimbal system is projected downward to the point.

26. The gimbal system of claim 13, further comprising a support mount having an inner cavity coupled to a portion of an outer surface of the gimbal shaft.

27. The gimbal system of claim 26, further comprising at least one screw or bolt threaded into a pattern of threaded holes extending through a portion of the support mount into an upper portion of the gimbal shaft that when torqued, draws the gimbal shaft into a press fit within the cavity of the support mount.

28. The gimbal system of claim 27, further comprising a pattern of countersunk holes disposed on a top surface of the gimbal shaft and complementary to a pattern of screws or bolts threaded through a top surface of the support mount wherein torquing of the screws or bolts releases the gimbal shaft from the press fit within the cavity of the support mount.

29. The gimbal system of claim 26, further comprising at least one anti-rotation pin communicating the support mount and the carrier mount to prevent independent rotation of the support mount with regard to the carrier mount.

30. A gimbal arrangement in a polishing apparatus, comprising:

a carrier mount having a first bearing surface;

a supporting mount;

a gimbal shaft interconnecting the carrier mount and the supporting mount, the gimbal shaft having a second bearing surface contacting the first bearing surface;

a third bearing surface supported by the carrier mount;

a fourth bearing surface which engages the third bearing surface; and an adjuster movably mounted to the gimbal shaft wherein movement of the adjuster with respect to the gimbal shaft varies the relative vertical positioning of the third bearing surface with respect to the second bearing surface; and a lock releasably engageable with the adjuster, which, when engaged, prevents movement of the adjuster with respect to the gimbal shaft.

31. A low profile adjustable gimbal system, comprising:

a first bearing surface adapted to be mounted to a portion of a carrier;

a gimbal shaft having a second bearing surface which engages the first bearing surface;

a third bearing surface adapted to be mounted to a portion of the carrier;

a fourth bearing surface which engages the third bearing surface;

an adjuster movably mounted to the gimbal shaft;

a locking mechanism abutting the adjuster wherein movement of the adjuster with respect to the gimbal shaft simultaneously varies the engagement between the first and second bearing surfaces, and the engagement between the third and fourth bearing surfaces;

wherein the locking mechanism comprises a washer abutting the adjuster, and at least one threaded member comprising at least one set screw abutting the washer; and wherein torquing of the at least one set screw binds the washer against the adjuster preventing movement of the adjuster with respect to the gimbal shaft.

32. A gimbal arrangement in a polishing apparatus, comprising:

a carrier mount;

a supporting mount;

a gimbal shaft interconnecting the carrier mount and the supporting mount;

at least one set of bearing surfaces between the gimbal shaft and the carrier mount;

an adjuster movably mounted to the gimbal shaft wherein movement of the adjuster with respect to the gimbal shaft varies a relative distance between the set of bearing surfaces; and a lock releasably engageable with the adjuster, which, when engaged, prevents movement of the adjuster with respect to the gimbal shaft.

* * * * *